US011807020B2

(12) United States Patent
Johnson et al.

(10) Patent No.: US 11,807,020 B2
(45) Date of Patent: Nov. 7, 2023

(54) THERMAL PAPER PREHEATING AND OPTICAL PRINTING

(71) Applicant: Toshiba Global Commerce Solutions Holdings Corporation, Tokyo (JP)

(72) Inventors: Brad M. Johnson, Raleigh, NC (US); Timothy W. Crockett, Raleigh, NC (US); Suzanne M. Bleakley, Durham, NC (US)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 0 days.

(21) Appl. No.: 17/191,122

(22) Filed: Mar. 3, 2021

(65) Prior Publication Data

US 2022/0281232 A1 Sep. 8, 2022

(51) Int. Cl.

| | |
|---|---|
| ***B41J 11/00*** | (2006.01) |
| ***B41J 2/44*** | (2006.01) |
| ***B41J 2/455*** | (2006.01) |
| ***B41J 2/475*** | (2006.01) |
| ***B41J 2/45*** | (2006.01) |

(52) U.S. Cl.

CPC ..... *B41J 2/4753* (2013.01); *B41J 2/442* (2013.01); *B41J 2/45* (2013.01); *B41J 2/455* (2013.01); *B41J 11/0015* (2013.01)

(58) Field of Classification Search

CPC . B41J 11/0015; B41J 2/442; B41J 2/45; B41J 2/455; B41J 2/4753

See application file for complete search history.

(56) References Cited

U.S. PATENT DOCUMENTS

| | | | | |
|---|---|---|---|---|
| 4,547,784 | A * | 10/1985 | Erlichman | H04N 1/40031 250/318 |
| 5,986,682 | A * | 11/1999 | Itou | G03G 15/346 347/171 |
| 2007/0098900 | A1* | 5/2007 | Abe | B41M 5/42 438/460 |
| 2008/0192107 | A1* | 8/2008 | Griffin | B41M 5/267 347/238 |
| 2008/0231657 | A1 | 9/2008 | Marsh et al. | |

FOREIGN PATENT DOCUMENTS

TW 200530049 A 9/2005

OTHER PUBLICATIONS

Wikipedia.prg, "LED Printer," Edited Apr. 25, 2020 [Retrieved Online Mar. 8, 2021] https://en.wikipedia.org/wiki/LED_printer.

* cited by examiner

*Primary Examiner* — Justin Seo
*Assistant Examiner* — Kendrick X Liu
(74) *Attorney, Agent, or Firm* — Patterson + Sheridan, LLP

(57) ABSTRACT

Thermal printing systems are described. The thermal printing systems and methods described provide efficient, compact, and fast thermal printing by providing preheating components that generate a priming thermal energy which preheats thermal paper in the printing system. The priming thermal energy decreases the amount of energy needed to activate the thermal paper during printing. The system and methods also include an optical print head which activates thermal paper using optical energy, which provides for multiple different types of efficient component configuration and increased speed of printing.

15 Claims, 8 Drawing Sheets

THERMAL PAPER PREHEATING AND OPTICAL PRINTING

BACKGROUND

The present invention relates to thermal printing systems, and more specifically relates to utilizing preheating processes and optical print heads to optimize printing speed and efficiency in thermal printing systems.

In some thermal printing systems, such as receipt printers, bulky and inefficient mechanical components are used to print images and text onto thermal paper. For example, typical thermal print heads rely on heated mechanical components which impart thermal energy via physical contact with thermal paper to print text/images onto the thermal paper. The physical interaction typically occurs on a specific side of the thermal paper (e.g., a chemical coated top side of the thermal paper) resulting in bulky and inefficient component configurations and the physical contact must take place for a time long enough to cause a chemical reaction on the thermal paper. This physical interaction also produces significant noise and limits a speed of printing in thermal printing systems. Improvements in configuration efficiency and printing speeds are needed in thermal printing systems.

SUMMARY

One example embodiment includes a printing system. The printing system includes a paper feeding mechanism providing a thermal paper along a paper path in the printing system. The system also includes an optical print head disposed on the paper path where the optical print head includes at least one optical energy source, where the at least one optical energy source prints onto the thermal paper by imparting optical energy onto the thermal paper to cause the thermal paper to activate. The system also includes at least one preheating element disposed between the paper feeding mechanism and the optical print head, where the at least one preheating element imparts priming thermal energy to the thermal paper prior to the thermal paper being provided to the optical print head.

Another example embodiment includes an optical print head. The optical print head also includes at least one optical energy source, where the at least one optical energy source prints onto a thermal paper by imparting optical energy onto the thermal paper to cause the thermal paper to activate, and where the optical print head receives the thermal paper from at least one preheating element, where the at least one preheating element imparts priming thermal energy to the thermal paper.

Another example embodiment includes a system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One example includes a method. The method includes receiving a thermal paper in a printing system, applying a priming thermal energy to the thermal paper, where the priming thermal energy heats the thermal paper to a near activation temperature, and imparting optical energy to print information onto the thermal paper by causing the thermal paper to activate the thermal paper. Other embodiments of this aspect include corresponding computer systems, apparatus, and computer programs recorded on one or more computer storage devices, each configured to perform the actions of the method.

DETAILED DESCRIPTION

Figure 1:
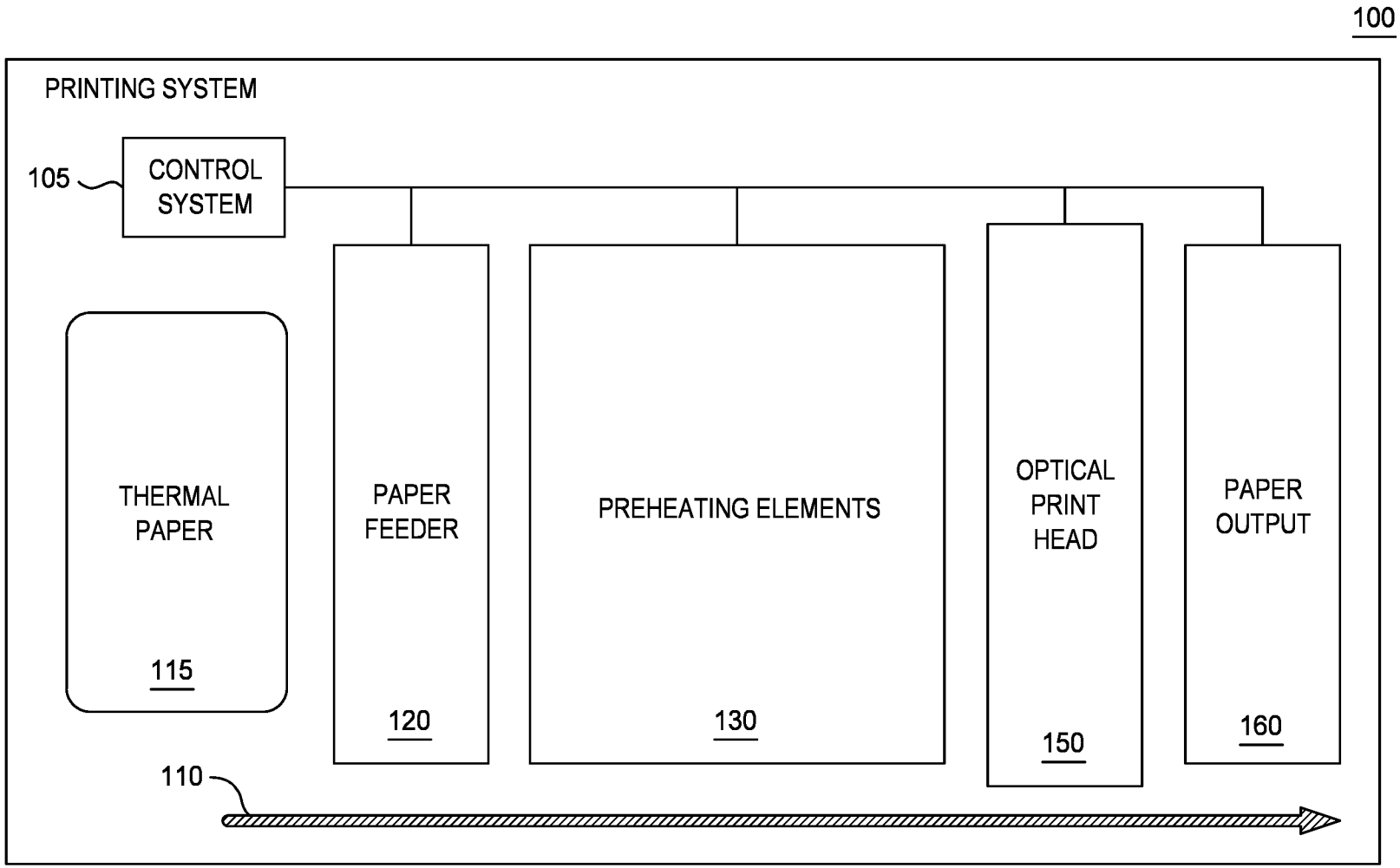
FIG. 1 illustrates a thermal printing system, according to one embodiment.

Thermal printing systems provide printing services in situations where providing both ink and paper to a printer is not efficient. For example, a common utilization of thermal printing systems is as receipt printers in retail or other environments, where providing a quick transaction record is desired. Providing both paper and ink at each point of service (POS) (e.g., checkout station) in a retail environment can quickly lead to inefficiency in keeping the printing supplies stocked at each POS. To address these limitation, thermal paper contains a chemical coating, which is activated by thermal printing systems, where activation causes portions of the thermal paper to change color which prints the desired text, images, etc., onto the thermal paper. With the utilization of thermal paper and thermal printing systems, only one type of supply (e.g. thermal paper) is needed at each POS simplifying the upkeep and maintenance of the systems.

While thermal printing provides the above described efficiencies, thermal printing systems continue to rely on mechanical components that must heat quickly enough to activate the thermal paper to print images clearly and cool quickly without causing smudges or jams in the printing systems. These mechanical limitations result in large and noisy thermal printing systems which require significant energy. While these relatively large and power intensive thermal printing systems can provide sufficient printing services at traditional POS's (e.g., at a wired checkout register) these systems cannot be effectively utilized in environments that rely on mobile or wireless POS devices.

For example, as retail environments transition to mobile POS devices such as mobile smart phones, tablets, etc., the use of thermal printers to print receipts becomes more cumbersome. For example, a customer desiring a receipt for a transaction at a mobile POS may have to wait for a receipt to print and be delivered from a thermal printer at a remote location (e.g., at a dedicated place in a retail environment where the thermal printing system can access wired energy sources).

Additionally, while energy resources are one limitation in preventing mobile thermal printing, the specific configurations for the mechanical components in thermal printing systems to successfully print without causing errors in the printing or paper handling in the thermal system, results in bulky and unwieldy thermal printing systems, which are not conducive to the desired mobility of mobile POS's. For example, mobile receipt printers are often dedicated devices that must be carried as a separate or additional device in addition to a mobile POS.

The thermal printing systems and methods described herein allow for efficient, compact, and fast thermal printing by providing preheating components that generate a priming thermal energy that preheats thermal paper in the printing system. The priming thermal energy decreases the amount of energy needed to activate the thermal paper during printing. The system and methods also include an optical print head which activates thermal paper using optical energy, which allows for multiple different types of efficient component configuration and increased speed of printing as described in relation to FIGS. 1-7.

FIG. 1 illustrates a thermal printing system, printing system 100, according to one embodiment. The printing system 100 includes various components which acting together move thermal paper through the printing system 100 along a paper path 110 and print an image onto thermal paper. In some examples, the various components are controlled by a control system 105, which provides control instructions to the various components in the printing system 100, in order to print images onto thermal paper as the thermal paper traverses the paper path 110.

In this example, the printing system 100 includes thermal paper 115 for printing in the paper path 110. The thermal paper 115 may include any kind of paper (e.g., receipt paper) which includes a thermal chemical coating or layer on at least one side of the thermal paper which reacts to applied energy (e.g., activates or otherwise changes color or composition) in order to print text, images, or other visual elements onto the paper. In some examples, the thermal paper 115 is a dedicated thermal paper designed for use in the printing system 100. For example, the thermal paper 115 may include a chemical coating or other design parameters designed specifically for use in a preheating and/or optical print head thermal printing system as described herein. Additionally, the thermal paper 115 may also include any generic thermal paper for use in a wide range of thermal printers. In both examples, the printing system 100 may print images onto the thermal paper 115 as the thermal paper is processed along the paper path 110.

In some examples, the thermal paper 115 begins traversing the paper path 110 at a paper feeder 120. The paper feeder 120 begins the process of moving the thermal paper 115 through the printing system 100 and the paper path 110. In some examples, the thermal paper 115 is a roll of paper and the paper feeder 120 interacts with the roll of thermal paper in order to feed or otherwise move the thermal paper along the paper path 110 and towards the other components of the printing system 100 as described in more detail in relation to FIG. 2.

The printing system 100 also includes preheating elements 130, an optical print head 150, and a paper output 160. In the paper path 110, the preheating elements 130 are disposed or otherwise positioned directly prior to the optical print head 150 in the paper path 110 (e.g., between the paper feeder 120 and the optical print head 150). The preheating elements 130 preheat or otherwise impart a priming thermal energy onto the thermal paper. In some examples, the priming thermal energy raises the temperature of the thermal paper 115 to a level that is higher than an ambient temperature inside the printing system 100, but without activating the thermal paper or causing a chemical reaction on the chemical coating of the thermal paper 115. The preheating elements 130 and priming thermal energy are described in more detail in relation to FIGS. 2-4.

The optical print head **150*h* includes at least one optical energy source that prints onto the thermal paper 115 by imparting optical energy onto the thermal paper to cause the thermal paper to activate—i.e., causing a chemical reaction on the chemical coating of the thermal paper 115. In some examples, the thermal paper 115 at the optical print head 150 is at an ambient temperature (e.g., not preheated by the preheating elements 130) when the optical print head 150 prints onto the thermal paper. In some examples, the optical print head 150 imparts optical energy onto the thermal paper 115 which is preheated by the preheating elements 130. The optical print head 150 is described in more detail in relation to FIGS. 2-5. In some examples, as the optical print head 150 prints onto the thermal paper 115, the thermal paper 115 continues along the paper path 110 to the paper output 160 which provides an egress for the thermal paper from the printing system 100 (e.g., provides the thermal paper 115 to a user, to a printed paper storage, etc.). The various components of the printing system 100 and the progress of the thermal paper 115 along the paper path 110 are shown in further detail in relation to FIG. 2**.

Figure 2:
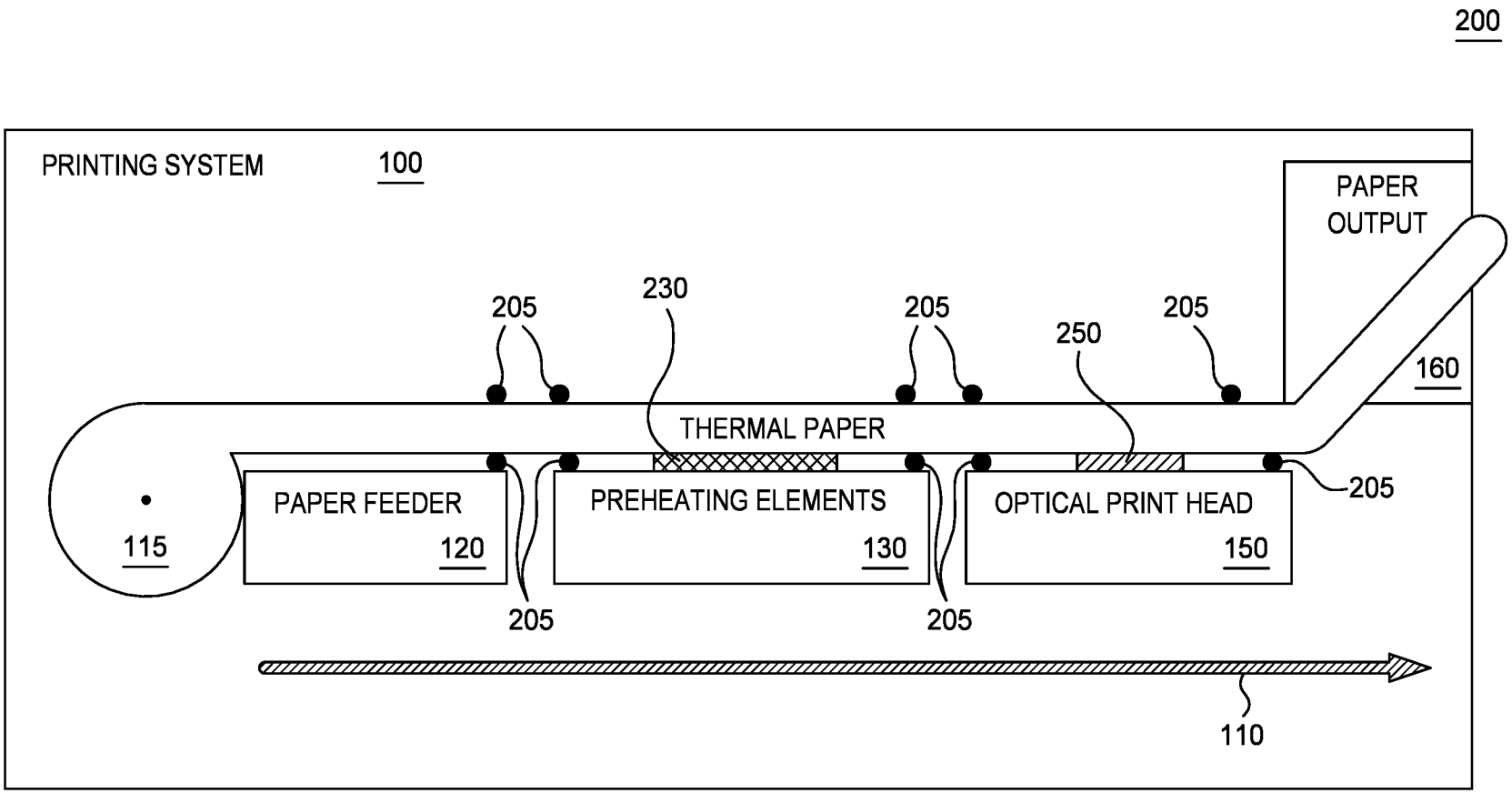
FIG. 2 illustrates a side view of a thermal printing system, according to one embodiment.

FIG. 2 illustrates a side view 200 of a thermal printing system, the printing system 100, according to one embodiment. In the side view 200, the paper feeder 120 is shown physically interacting with the thermal paper 115 (shown as a paper roll) to feed the thermal paper 115 along the paper path 110. In some examples, the printing system 100 also includes additional paper handling mechanisms, paper handling mechanisms 205, along the paper path 110. For example, the paper feeder 120, preheating elements 130, and the optical print head 150 include one or more paper handling mechanisms 205 (e.g., rollers or other paper moving elements) which move the paper along the paper path 110 and within each of the respective components.

In some examples, the paper handling mechanisms 205 are coordinated by the control system 105 shown in FIG. 1, by the paper feeder 120, and/or by each of the respective printing system components. For example, the paper handling mechanisms 205 may all progress the paper forward at a same speed at each of the components in the printing system 100 based on a central control provided by the control system 105 or the paper feeder 120. In some examples, the paper feeder 120 and the mechanisms 205 may also be embodied as subcomponents or subsystems of at least the preheating elements 130 and/or the optical print head 150.

In some examples, the paper handling mechanisms 205 prevent the thermal paper 115 from physically touching or physically interacting with the preheating elements 130 and the optical print head 150. This avoid problems experienced by mechanically based thermal print heads where the use of lower quality thermal paper can cause system wear and damages as the lower quality thermal paper can cause various mechanical malfunctions as the paper moves through a thermal printing system. For example, some types of thermal paper may shed chemical residue, paper products, or other solid particles while being handled by mechanical components in a thermal printing system.

In the printing system 100, the spacing provided by the paper handling mechanisms 205 between the thermal paper 115 and the preheating elements 130 and optical print head 150, prevents paper jams in the printing system 100 as well as prevents the above described debris or other residue from building up on the components of the printing system 100. The paper handling mechanisms 205 also prevents this debris from shedding in the first place since physical contact with the printing system 100 components is minimized, which in turn lowers maintenance and repair time as well as extends an operating life of the printing system 100. In some examples, as the paper handling mechanisms 205 move the thermal paper 115 along the paper path 110, a priming thermal energy is applied to the thermal paper.

As described above in relation to FIG. 1, the preheating elements 130 impart a thermal energy 230 onto the thermal paper 115 such that as the thermal paper 115 moves from the preheating elements 130 to the optical print head 150, the paper is thermally primed and/or close to an activating temperature. The activated portion of the thermal paper allows for less energy to be expended by the optical print head 150 when printing onto the thermal paper.

The optical print head 150 then imparts the optical energy 250 onto the thermal paper 115 with sufficient energy to cause the thermal paper 115 to activate and print the desired text/images onto the thermal paper 115. The priming of the thermal paper 115 at the preheating elements lowers the amount of optical energy required in optical energy 250 to print onto the thermal paper 115. The optical print head 150 may also impart the optical energy 250 onto unprimed thermal paper, where the optical energy 250 activates the thermal paper 115 without additional priming by the preheating elements 130.

In some examples, the thermal paper 115 is a single sided thermal paper which includes a chemical coating on only one side of the thermal paper 115. In the arrangements of the printing system 100 shown in FIGS. 3A-3B, the optical print head 150 may impart energy on either the chemically coated side or the non-chemically coated side of the thermal paper 115.

Figure 3A:
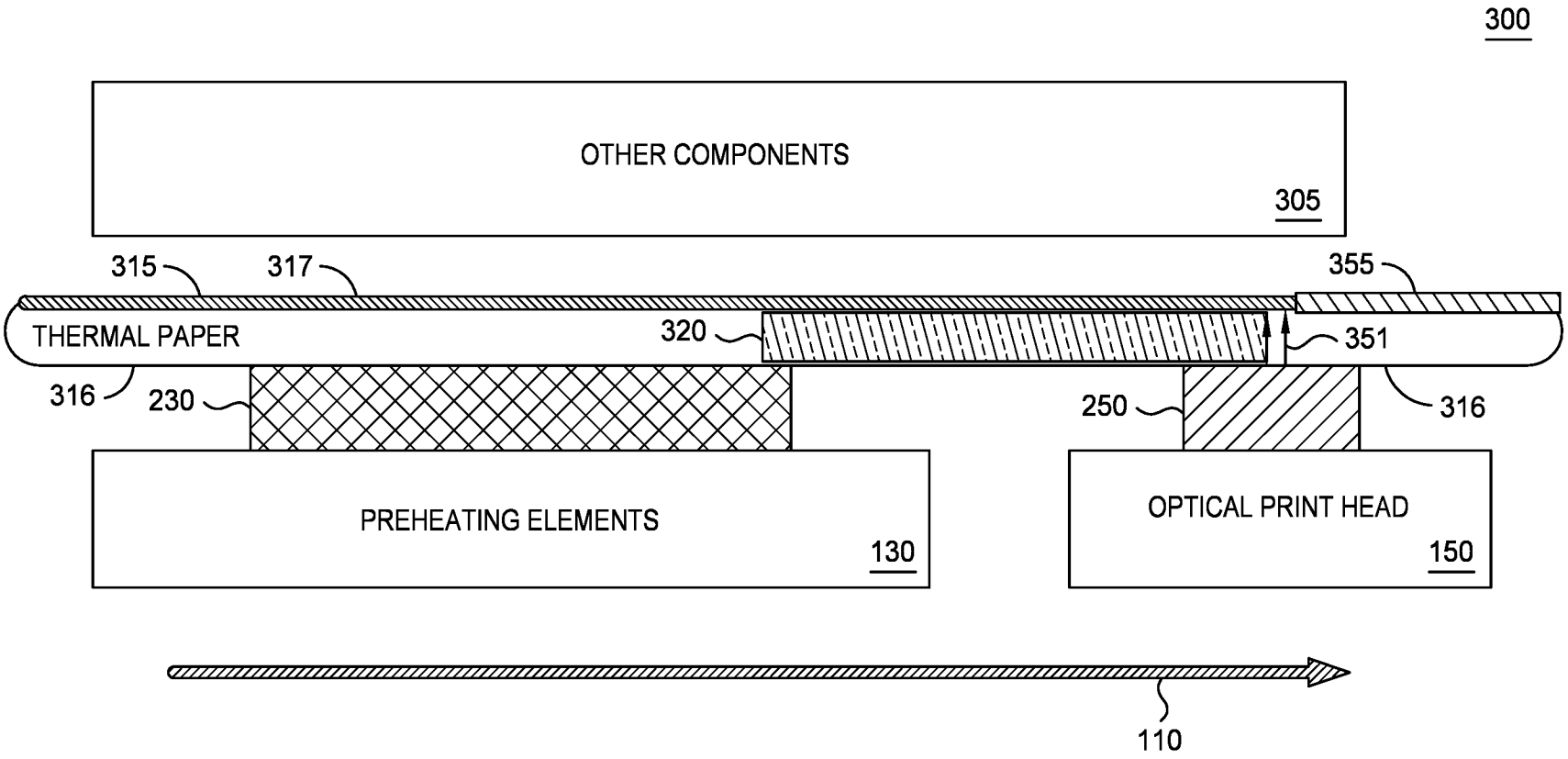
FIG. 3A illustrates a side view of a thermal printing system in a reverse side arrangement, according to one embodiment.

FIG. 3A illustrates a side view of a thermal printing system in a reverse side arrangement 300, according to one embodiment. For ease of depiction the paper feeder 120, the paper output 160, and the paper handling mechanisms 205 described in relation to FIGS. 1 and 2 are not shown in FIG. 3A, but may interact with the components shown in the arrangement 300. In some examples, the arrangement 300 includes the preheating elements 130 and the optical print head 150 imparting their respective thermal and optical energy on a reverse side of the thermal paper 115 opposite of a thermal coating.

For example, the thermal paper 115 has a chemical coating 315 on a first side 317 of the thermal paper 115. The preheating elements 130 imparts the thermal energy 230 onto a second side 316 of the thermal paper in order to prime the paper for activation. A primed section 320 of the thermal paper 115 is activated by the optical print head 150 thereby imparting optical energy 250 onto the second side 316, where the optical energy 351 passes through the thermal paper 115 which activates the chemical coating which produces a printed section 355 of the thermal paper 115.

While in some examples, the primed section 320 allows for less optical energy to be used to activate the chemical coating 315, the optical print head 150 may also impart the optical energy 205 a non-primed section of the thermal paper 115. For example, the optical print head 150 may impart optical energy 250 to thermal paper 115 at an ambient or non-primed temperature to produce the printed section 355.

In some examples, the arrangement 300 provides for advantageous positioning of the relatively more bulky components in a printing system (e.g., the optical print head 150, and the preheating elements 130). For example, the optical print head 150 may to be efficiently positioned under the thermal paper 115 (e.g., opposite the chemical coating 315), which allows other components 305 to be positioned or disposed above the paper path 110. For example, other components 305 may include a user interface or display that together with printing system 100 make up a mobile POS. The other components may be positioned above the arrangement 300 without greatly increasing an overall size of the mobile POS.

Figure 3B:
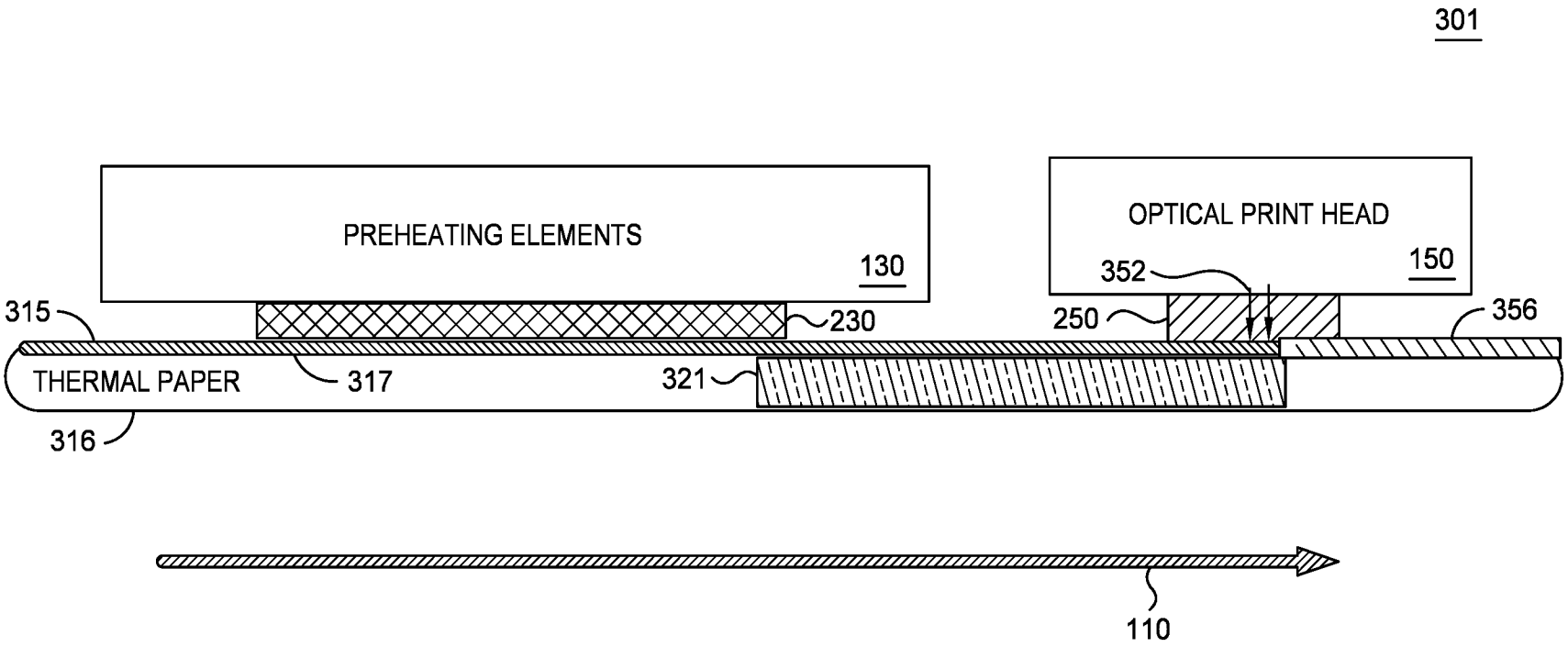
FIG. 3B illustrates a side view of a thermal printing system in a same side arrangement, according to one embodiment.

FIG. 3B illustrates a side view of a thermal printing system in a same side arrangement 301, according to one embodiment. The arrangement 301 is also an arrangement of the various components of the printing system 100, for ease of depiction the paper feeder, the paper output, and the paper handling mechanisms described in relation to FIGS. 1 and 2 are not shown in FIG. 3B, but may interact with the components shown in the arrangement 301. In some examples, the arrangement 301 includes the preheating elements 130 and the optical print head 150 imparting their respective thermal and optical energy on a same side of the thermal paper 115 as a thermal coating.

For example, the thermal paper 115 contains the chemical coating 315 on the first side 317 of the thermal paper 115 and no coating on the second side 316. The preheating elements 130 imparts the thermal energy 230 onto the first side 317 of the thermal paper in order to prime the paper for activation. A primed section 321 of the thermal paper 115 is activated by the optical print head 150 imparting optical energy 250 onto the first side 317, where the optical energy 352 directly activates the chemical coating 315 which produces a printed section 356 of the thermal paper 115.

In some examples, the printing system 100 may also include a combination of the arrangements 300 and 301. For example, the preheating elements may be positioned on one side of the thermal paper 115 and the optical print head 150 on another side of the thermal paper 115. In any arrangement, as the thermal paper 115 travels along the paper path 110, the thermal paper 115 is prepared for printing and activated as shown in FIG. 4.

Figure 4:
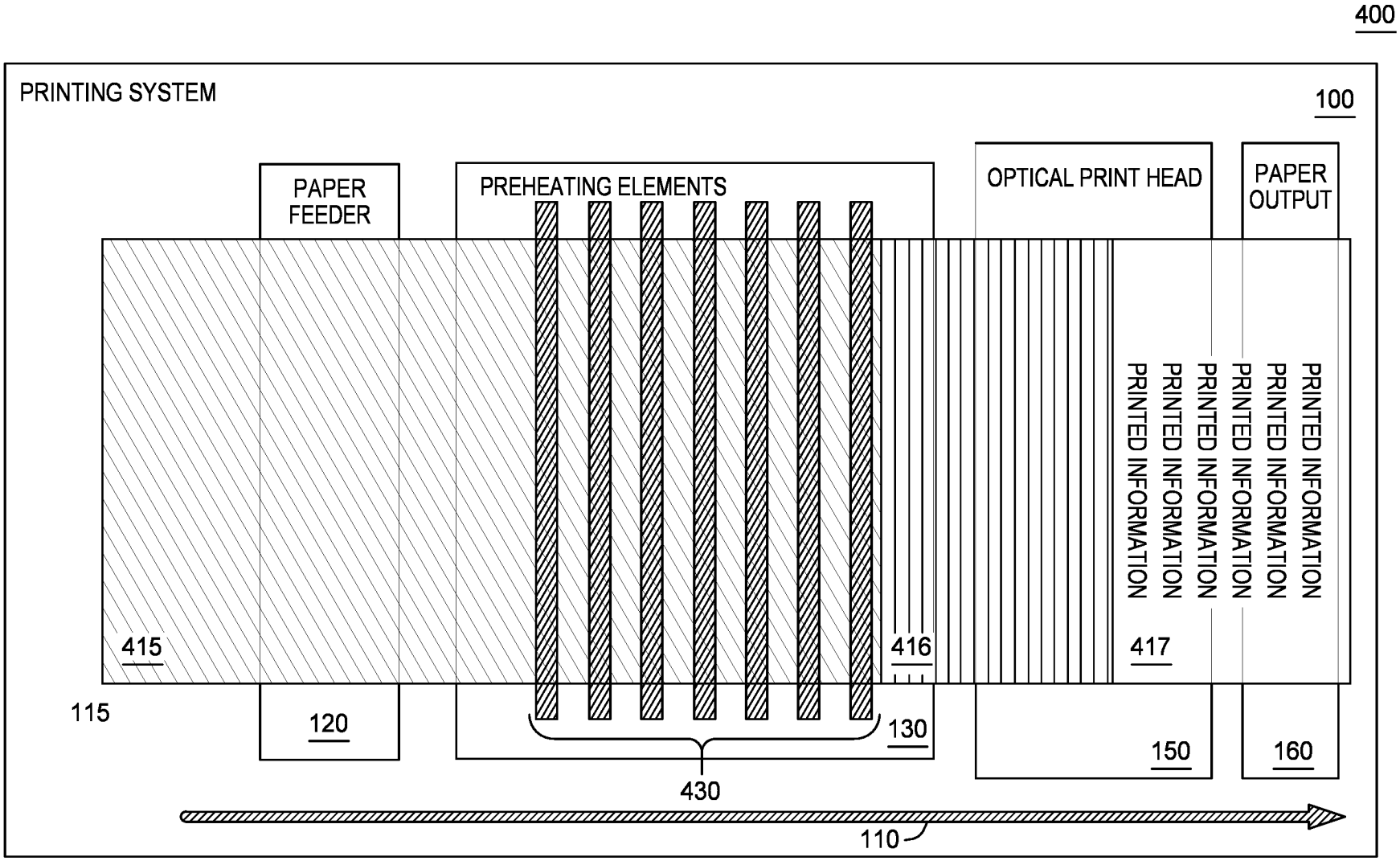
FIG. 4 illustrates a top view of thermal paper passing through a thermal printing system, according to one embodiment.

FIG. 4 illustrates a top view 400 of thermal paper 115 passing through a thermal printing system, printing system 100, according to one embodiment. The thermal paper 115 includes a pre-activated section 415 of the thermal paper 115, where the pre-activated section 415 includes a chemical coating as shown in FIGS. 3A-B that has not been activated/printed by a thermal printing system. The thermal paper 115 travels along the paper path 110 to the preheating elements 130.

In some examples, the preheating elements 130 include a printed circuit board (PCB) with at least one PCB copper element such as elements 430 on the PCB. The elements 430 provide thermal energy in order to prime the thermal paper 115 for optical activation. The elements 430 impart enough thermal energy to prime the thermal paper 115 to primed section 416, where the primed section is not activated. While shown as a PCB, the preheating elements 130 may also include other elements that generate and impart heat onto the thermal paper 115.

The optical print head 150 imparts optical energy onto the thermal paper 115 (e.g., on the primed section 416), to produce a printed section 417 of the thermal paper 115 which includes the desired printed sections on the thermal paper 115. The thermal paper 115 including the printed section 417 is provided to a user, etc. via the paper output 160. In some examples, the optical print head includes a variety of optical energy sources as discussed in FIGS. 5A-B.

Figure 5B:
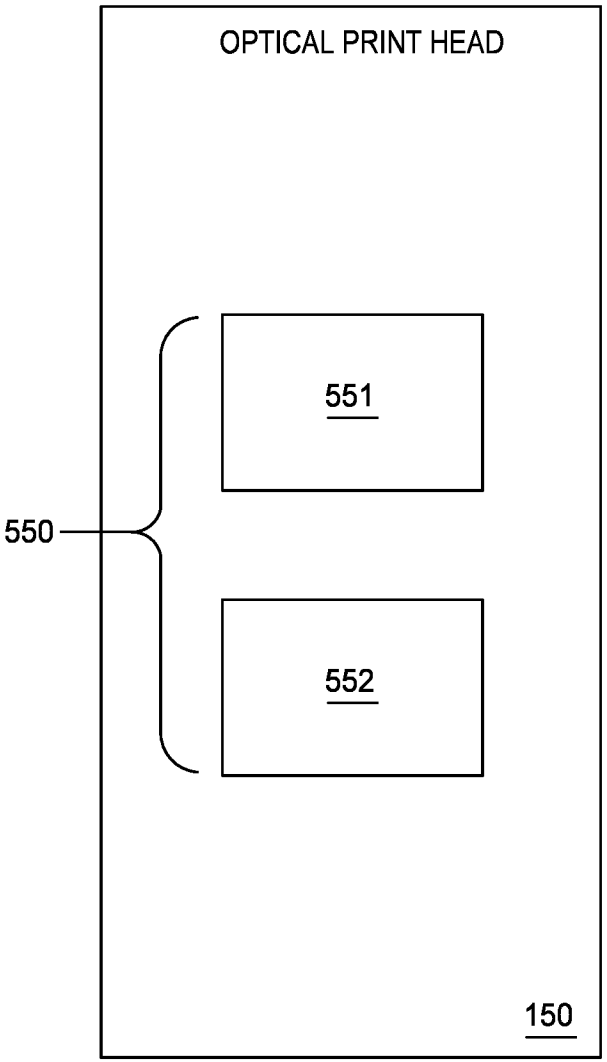
FIGS. 5A and 5B illustrates optical print heads, according to embodiments.
Figure 5A:
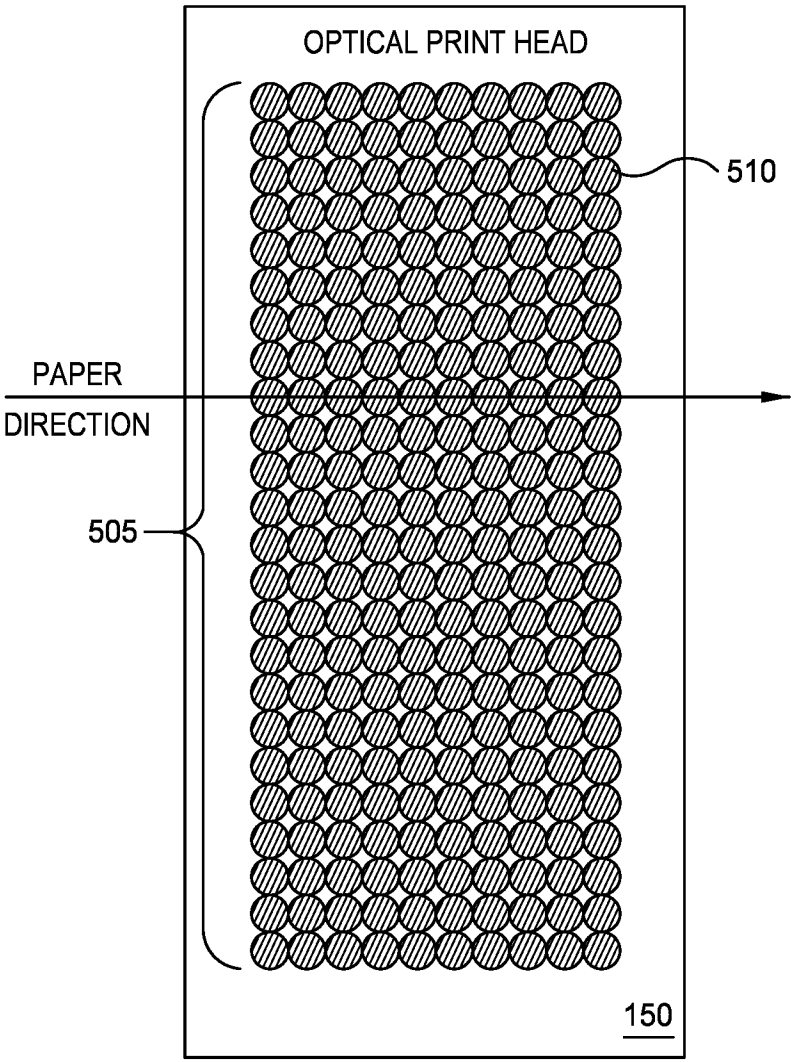

FIG. 5A illustrates an optical print head 150, according to one embodiment. In some examples, the optical print head 150 includes a plurality of light emitting diodes (LED) in an LED array, such as LED array 505 which includes a plurality of LEDs, such as LED array 510. In some examples, the LED array 510 emits optical energy such as infrared optical energy, ultraviolet optical energy, or other light energy along the optical spectrum. In some examples, the LED array emits sufficient energy to activate a chemical layer on the thermal paper 115 (e.g., the chemical coating 315) shown in FIGS. 3A-B, which prints information onto the thermal paper 115. In some examples, only a subset of LEDs of the LED array 510 is activated at any given time in order to print information onto the thermal paper 115.

FIG. 5B illustrates an optical print head 150, according to one embodiment. In some examples, the optical print head 150 includes a scanning laser 550, which may include one or more moving or scanning laser heads, such as laser heads 551 and 552. The scanning laser 550 imparts optical energy such as described in FIGS. 1-4. In some examples, the laser heads 551 and 552 emit optical energy such as infrared light, ultraviolet, light or other light energy on the electromagnetic spectrum. In some examples, the laser heads 551 and 552 array emits sufficient energy to activate a chemical layer on the thermal paper 115 (e.g., the chemical coating 315) shown in FIGS. 3A-B, which prints information onto the thermal paper 115.

Figure 6:
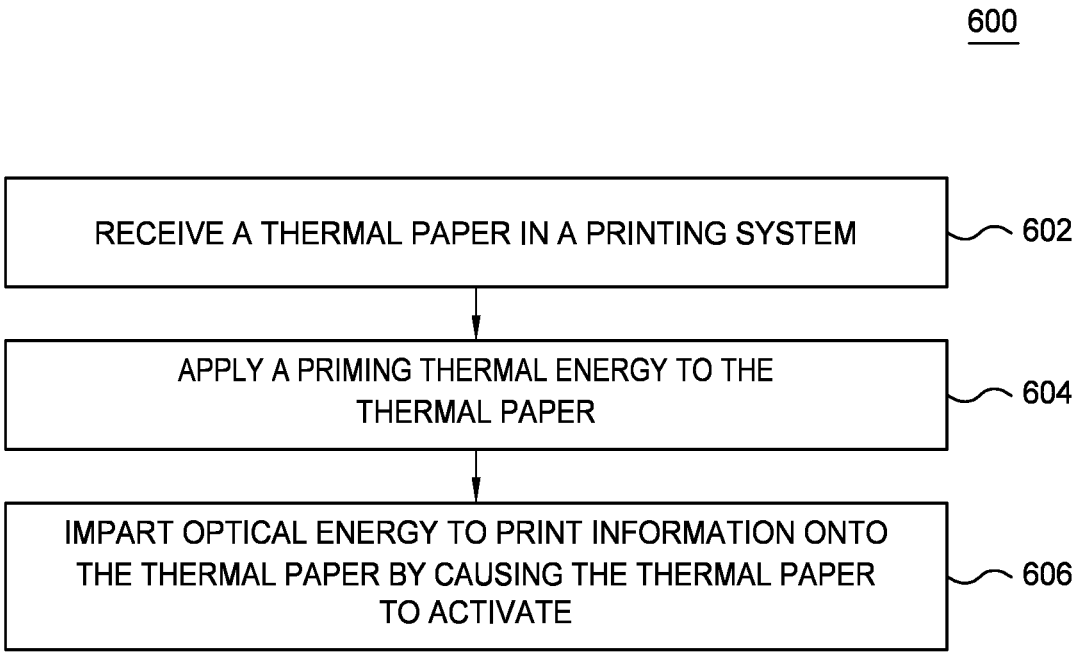
FIG. 6 is a method for thermal printing, according to one embodiment.

FIG. 6 is a method for thermal printing, according to one embodiment. Method 600 begins at block 602 where the printing system 100 receives thermal paper. For example, the printing system 100 including the paper feeder 120 and the mechanisms 205 receive the thermal paper 115 and move the thermal paper 115 along the paper path 110. In some examples, the paper feeder 120 and the mechanisms 205 interact with each other and the various components of the printing system 100 to move the thermal paper 115 along the path in a synchronous manner in order to avoid misprints, paper jams, etc., in the printing system 100. Additionally, while shown as independent components in the printing system 100, the paper feeder 120 and the mechanisms 205 may also be embodied as subcomponents or subsystems of at least the preheating elements 130 and/or the optical print head 150. For example, the optical print head 150 may include the paper feeder 120 and paper handling mechanisms 205 as a component of the optical print head 150 such that an independent paper feeder is not needed.

At block 604, the printing system 100 applies a priming thermal energy to the thermal paper. For example, as the printing system 100 and the preheating elements 130 apply the thermal energy 230 in order to prime the thermal paper 115 for activation. In some examples, the priming thermal energy may be applied to a reverse side of the thermal paper 115 as shown in FIG. 3A or to directly to a thermal coating on a first side as shown in FIG. 3B. The preheating elements may also include PCB copper elements as described in relation to FIG. 4 or may include other types of heating elements which may impart the priming thermal energy to the thermal paper.

At block 606, the printing system 100 imparts optical energy to print information onto the thermal paper by causing the thermal paper to activate. For example, the printing system 100 and the optical print head 150 applies the optical energy 250 to print various images and text onto the thermal paper 115. In some examples, the optical print head may impart enough energy to the thermal paper 115 such that preheating is not needed (i.e., the thermal paper 115 may not be preheated by the preheating elements). Additionally, in some examples, the optical energy may be imparted on either a reverse side of the thermal paper 115 (e.g., as shown in FIG. 3A) or a first side of the thermal paper 115 which includes a chemical coating (e.g., as shown in FIG. 3B). As described in relation to FIG. 5A and FIG. 5B, the optical energy may be imparted onto the thermal paper 115 using an LED array 505, a scanning laser 550, or a combination of light emitting components which may impart sufficient light energy to activate the thermal paper to print information onto the paper.

Figure 7:
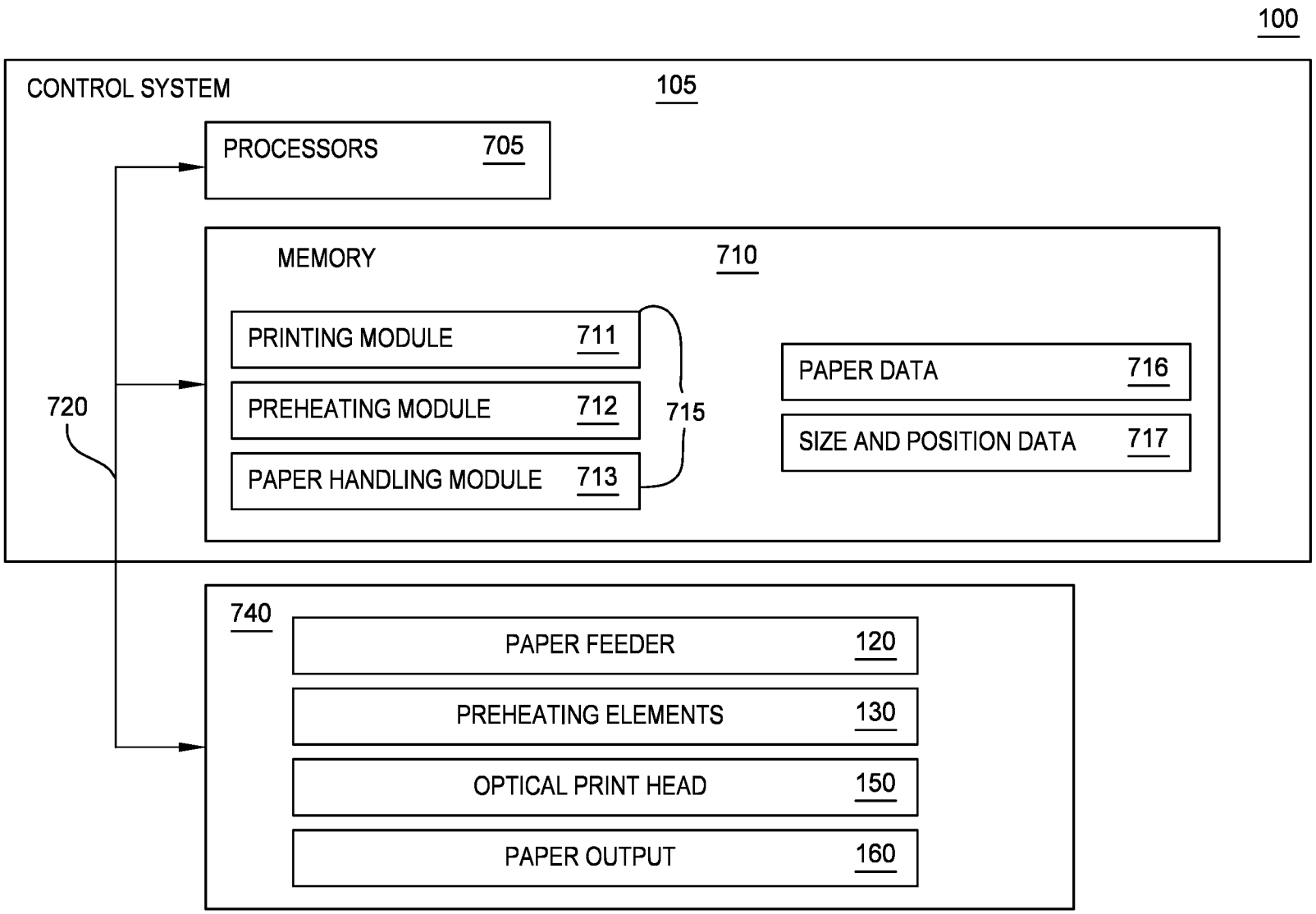
FIG. 7 is a block diagram illustrating a thermal printing system, according to one embodiment.

FIG. 7 is a block diagram illustrating a thermal printing system, the printing system 100, according to one embodiment. Specifically, FIG. 7 illustrates an exemplary control system, the control system 105. While shown as a single control system, the control system may be distributed among system components 740 such that the system components 740 may function in according to distributed control commands. The control system 105 includes a number of processors 705, memory 710, which are interconnected and connected to system components 740 using one or more connections 720.

In one embodiment, the control system 105 and/or the printing system 100 may be implemented as a singular computing device and connection 720 may represent a common bus. In other embodiments, the control system 105 and/or the printing system 100 is distributed and includes a plurality of discrete computing devices that are connected through wired or wireless networking such as a wireless network. The processors 705 may include any processing element suitable for performing functions described herein, and may include single or multiple core processors, as well as combinations thereof. Processors 705 may be included in a single computing device, or may represent an aggregation of processing elements included across a number of networked devices.

Memory 710 may include a variety of computer-readable media selected for their size, relative performance, or other capabilities: volatile and/or non-volatile media, removable and/or non-removable media, etc. Memory 710 may include cache, random access memory (RAM), storage, etc. Storage included as part of memory 710 may typically provide a non-volatile memory for the networked computing devices, and may include one or more different storage elements such as Flash memory, a hard disk drive, a solid state drive, an optical storage device, and/or a magnetic storage device. Memory 710 may be included in a single computing device or may represent an aggregation of memory included in networked devices. Memory 710 may include a plurality of modules 715 for performing various functions described herein. The modules 715 generally include program code that is executable by one or more of the processors 705.

As shown, modules 715 include printing module 711, preheating module 712, and paper handling module 713. The modules 715 may also interact to perform certain functions such as described in FIGS. 1-6 including the methods described in FIG. 6. The person of ordinary skill will recognize that the modules provided here are merely non-exclusive examples; different functions and/or groupings of functions may be included as desired to suitably operate the environment. Memory 710 may also include paper data 716 and size and position data 717. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure is not limited to specific described embodiments. Instead, any combination of the preceding features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A printing system comprising:

a paper feeding mechanism configured to provide a thermal paper along a paper path in the printing system, wherein the thermal paper comprises a thermal chemical disposed on a first side of the thermal paper;

an optical print head disposed on the paper path comprising at least one optical energy source, where the at least one optical energy source prints onto the thermal paper by imparting optical energy onto a reverse side of the thermal paper, wherein the optical energy passes through the thermal paper to cause the thermal chemical disposed on the first side to activate, wherein the optical print head comprises a first paper handling mechanism positioned between the optical print head and the thermal paper to keep the thermal paper from physically contacting the optical energy source; and at least one preheating element disposed between the paper feeding mechanism and the optical print head, wherein the at least one preheating element imparts priming thermal energy to the thermal paper prior to the thermal paper being provided to the optical print head, wherein the at least one preheating element comprises a second paper handling mechanism positioned between the at least one preheating element and the thermal paper to keep the thermal paper from physically contacting the optical energy source.

2. The printing system of claim 1, wherein the thermal paper comprises a single sided thermal paper.

3. The printing system of claim 2, wherein the optical print head further imparts the optical energy on the first side of the thermal paper.

4. The printing system of claim 1, wherein the at least one preheating element comprises at least one printed circuit board copper element.

5. The printing system of claim 1, wherein the printing system comprises a paper handling mechanism associated with the at least one preheating element, wherein the paper handling mechanism keeps the thermal paper from physically contacting the at least one preheating element.

6. The printing system of claim 1, wherein the optical energy source comprises at least one of:

an array of light emitting diodes; and a scanning laser.

7. The printing system of claim 1, wherein the optical energy source imparts at least one of:

infrared optical energy; and ultraviolet optical energy.

8. An optical print head comprising:

at least one optical energy source, where the at least one optical energy source prints onto a thermal paper by imparting optical energy onto the thermal paper to cause the thermal paper to activate, wherein the optical print head comprises a first paper handling mechanism positioned between the optical print head and the thermal paper to keep the thermal paper from physically contacting the at least one optical energy source, wherein the thermal paper comprises a thermal chemical disposed on a first side of the thermal paper, wherein the at least one optical energy source imparts the optical energy onto a reverse side of the thermal paper, wherein the optical energy passes through the thermal paper to cause the thermal chemical disposed on the first side to activate, wherein the optical print head receives the thermal paper from at least one preheating element comprising a second paper handling mechanism positioned between the at least one preheating element and the thermal paper to keep the thermal paper from physically contacting the at least one optical energy source, and wherein the at least one preheating element imparts priming thermal energy to the thermal paper.

9. The optical print head of claim 8, wherein the thermal paper comprises a single sided thermal paper with a thermal chemical disposed on the first side of the thermal paper wherein the optical print head imparts the optical energy on at least one of:

the first side of the thermal paper; and a reverse side of the thermal paper, wherein the optical energy activates the thermal chemical disposed on the first side of the thermal paper.

10. The optical print head of claim 8, wherein the optical energy source further comprises at least one of:

an array of light emitting diodes; and a scanning laser.

11. The optical print head of claim 8, wherein the optical energy source imparts at least one of:

infrared optical energy; and ultraviolet optical energy.

12. A method comprising:

receiving a thermal paper in a printing system, wherein the thermal paper comprises a thermal chemical disposed on a first side of the thermal paper;

applying, via at least one preheating element in the printing system, a priming thermal energy to the thermal paper, where the priming thermal energy heats the thermal paper to a near activation temperature, wherein the at least one preheating element comprises a first paper handling mechanism positioned between the at least one preheating element and the thermal paper to keep the thermal paper from physically contacting an optical energy source in the printing system; and imparting, via an optical print head comprising the optical energy source, optical energy onto a reverse side of the thermal paper to print information onto the thermal paper by causing the thermal chemical disposed on the first side to activate, wherein the optical energy passes through the thermal paper, and wherein the optical print head comprises a second paper handling mechanism positioned between the optical print head and the thermal paper to keep the thermal paper from physically contacting the optical energy source.

13. The method of claim 12, wherein the thermal paper comprises a single sided thermal paper, wherein imparting optical energy further comprises:

imparting the optical energy to the first side of the thermal paper.

14. The method of claim 12, wherein the optical energy source imparts the optical energy, wherein the optical energy source comprises at least one of:

an array of light emitting diodes; and a scanning laser.

15. The method of claim 14, wherein the at least one preheating element is disposed between a paper feeding mechanism and the optical energy source, wherein the at least one preheating element imparts the priming thermal energy to the thermal paper prior to the thermal paper being provided to the optical energy source.

* * * * *